US006764115B1

(12) United States Patent
Speed et al.

(10) Patent No.: US 6,764,115 B1
(45) Date of Patent: Jul. 20, 2004

(54) SNAP LOCK

(76) Inventors: Daryl F. Speed, 4422 Yew Street, Vancouver, B.C. (CA), V6L 3C8; Brent A. Foster, 2412 Mountain Dr., Abbotsford, B.C. (CA), V3G 1E7; Mark Rees-Howlett, 34845 Cooper Place, Abbotsford, B.C. (CA), V2S 7K6

( * ) Notice: Subject to any disclaimer, the term of this patent is extended or adjusted under 35 U.S.C. 154(b) by 0 days.

(21) Appl. No.: 10/633,990

(22) Filed: Aug. 5, 2003

(51) Int. Cl.[7] ..... E05B 63/20

(52) U.S. Cl. ..... 292/334; 292/335; 292/158; 292/DIG. 46

(58) Field of Search ..... 292/156–158, 292/139, 167, 334, 335, DIG. 46

(56) References Cited

U.S. PATENT DOCUMENTS

| | | | | | |
|---|---|---|---|---|---|
| 2,721,750 | A | * | 10/1955 | Rudis et al. | 292/139 |
| 2,874,986 | A | * | 2/1959 | Henrichs | 292/167 |
| 4,828,299 | A | * | 5/1989 | Poe | 292/139 |
| 4,911,485 | A | * | 3/1990 | Wasilewski | 292/139 |
| 4,961,286 | A | * | 10/1990 | Bezubic | 49/175 |
| 5,028,082 | A | | 7/1991 | Kronbetter | |
| 5,511,833 | A | | 4/1996 | Tashman et al. | |
| 5,601,319 | A | * | 2/1997 | Morin | 292/139 |
| 5,603,535 | A | | 2/1997 | Antonucci et al. | |
| 5,620,213 | A | | 4/1997 | Ellis | |
| 5,975,556 | A | * | 11/1999 | Lehmann | 280/624 |
| 6,497,437 | B1 | * | 12/2002 | Munch et al. | 292/336.3 |

* cited by examiner

*Primary Examiner*—Gary Estremsky
(74) *Attorney, Agent, or Firm*—Frederick Kaufman

(57) ABSTRACT

A snap lock for securing to a sash of a sliding window or door by interacting with a striking plate and for securing to a frame of the sliding window or door. The snap lock comprises stationary lower and upper plates for sandwiching a rectilinearly mobile plate for locking the snap lock with respect to the striking plate. The snap lock includes as well: a three-point pivoting mechanism for interconnecting the foregoing plates to perform an unlocking operation; a springy feature for keeping, when relieved from tension, the rectilinearly mobile plate in an unlocked, retracted position, and when under tension, for keeping the rectilinearly mobile plate in a locked position, the springy feature being attached to the stationary lower and upper plates and being actuated by a contact with the striking plate; and a cover having an aperture for locating and accessing a button for acting upon the three-point pivoting mechanism.

2 Claims, 7 Drawing Sheets

SNAP LOCK

I. BACKGROUND OF THE INVENTION

1. Field of the Invention

The present invention relates to snap locks in general and, more specifically, to snap locks for sliding windows and doors.

2. Description of the Prior Art

The particular class of latches to which the present invention pertains uses latching plates with latching shoulders, between which a land to provide an abutment is formed. The latching shoulders are inclined with respect to a vertical surface of a window frame. For example, U.S. Pat. No. 5,901,501 dated May 11, 1999 and granted to Fountaine for a "Window Fastener" describes a lock for use with a sliding sash window. The lock has a body with a handle mounted with the body for pivotal movement about a pivot axle. A latch tongue is operatively coupled to the handle and a latch tongue is provided with a latching surface for contacting an end of the latch tongue. The latching surface is spaced from the pivot axle in the direction in which a sash of a window is movable from a closed position relative to the frame of the window. The handle is movable about the pivot axle to move the end of the latch tongue away from its latching contact of the latching surface of the latch plate. Thus, the window sash can be moved from the closed position. Fountain's "Window Fastener" has several important shortcomings. First, the latching tongues are moveable independent of each other and of the handle. Second, limited pivot movement of the tongues by the handle. Third, sliding action is not rectilinear.

II. SUMMARY OF THE INVENTION

Based on the analysis of the prior art, there is a need for a snap lock which eliminate or, at least, alleviate the foregoing shortcomings.

A first objective of the present invention is to provide a simple and reliable snap lock.

A second objective of the present invention is to provide a snap lock with a rectilinear movement of the latching element.

A third objective of the present invention is to provide a snap lock held in an open position while the sliding window or door is open.

A fourth objective of the present invention is to develop a snap lock provided with alignment and security means.

A fifth objective of the present invention is to provide a snap lock with extended service life.

A sixth objective of the present invention is to provide a snap lock that satisfies the demands of technical aesthetics.

Broadly stating, the snap lock according to the present invention is adaptable to be secured to a sash of a sliding window or door and to interact with a striking plate having horizontal and vertical plates and also adaptable to be secured to a frame of the sliding window or door. The snap lock comprises stationary lower and upper plates for capturing between them a rectilinearly mobile plate for locking the snap lock with respect to the striking plate. The snap lock includes as well:

a three-point pivoting mechanism for interconnecting the foregoing plates and, thereby, enabling to perform an unlocking operation;

a springy feature for keeping, when relieved from tension, the rectilinearly mobile plate for locking the snap lock with respect to the striking plate in an unlocked, retracted position, and when under tension, for keeping the rectilinearly mobile plate for locking the snap lock with respect to the striking plate in a locked, forwardly protruding position, the springy feature being attached to the stationary lower and upper plates for capturing and being actuated by a contact with the vertical plate; and a cover provided with an aperture for locating and accessing a button for acting upon the three-point pivoting mechanism for interconnecting.

According to one aspect of this invention, the springy feature for keeping, when relieved from tension, the rectilinearly mobile plate for locking the snap lock with respect to the striking plate in an unlocked, retracted position, and when under tension, for keeping the rectilinearly mobile plate for locking the snap lock with respect to the striking plate in a locked, forwardly protruding position, includes a pair of flat springs. Each of said pair of flat springs has basically a U-shape and is provided with a short lower and long upper arms. The short lower arm extends laterally into an eyelet adapted for inserting a rivet that is eventually forced into flat spring holes and corresponding flat spring holes disposed in the stationary lower and upper plates for capturing. The long upper arm continues downwardly and perpendicularly at one side with a double bent end and at another side with a cantilevered end located besides the double bent end.

III. BRIEF DESCRIPTION OF THE DRAWINGS

Although the characteristic features of the invention will be particularly pointed out in the claims, the invention itself, and the manner in which it may be made and used, may be better understood by referring to the following description taken in connection with the accompanying drawings forming part thereof, wherein like reference numerals refer to like parts throughout the several views in which:

FIG. 1 is an exploded perspective view of a snap lock according to the preferred embodiment of the present invention;

FIG. 1' is an assembled perspective view, without a cover, of the snap lock of FIG. 1;

IV. DESCRIPTION OF THE PREFERRED EMBODIMENT

Figure 1:
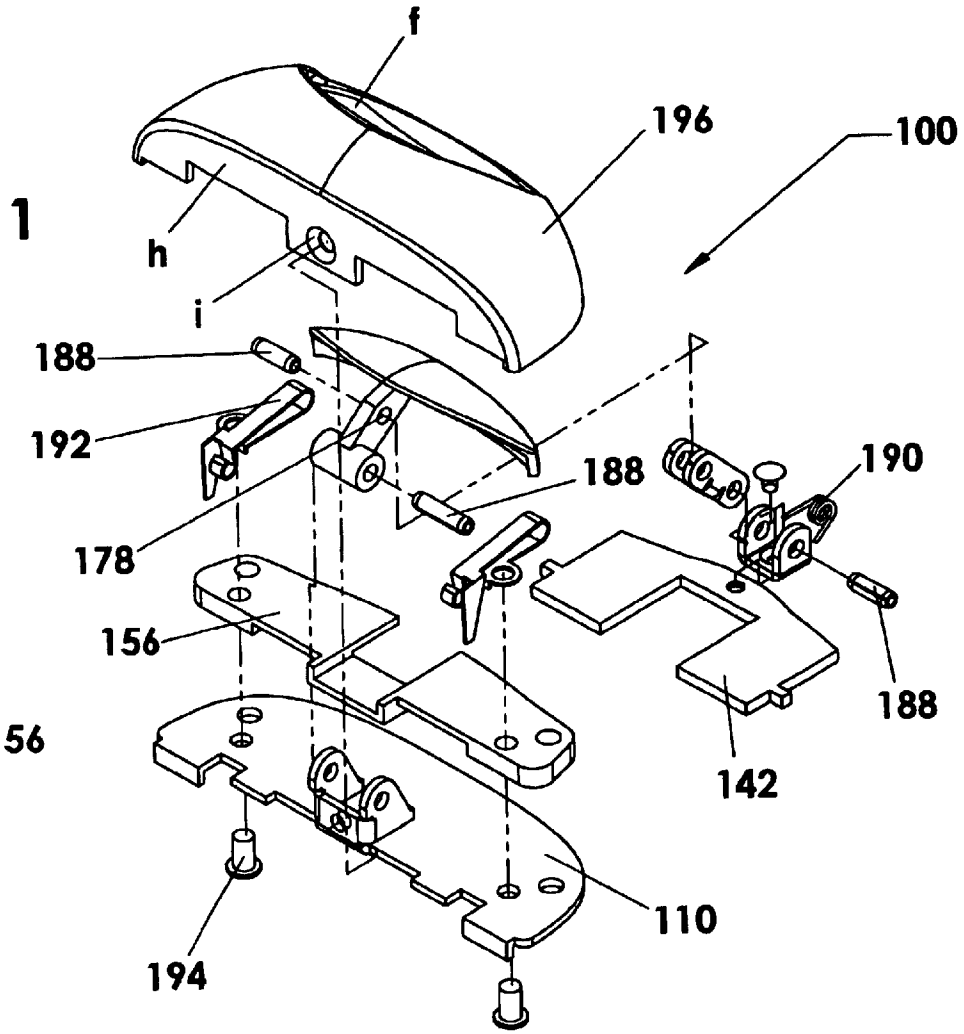
Figure 1:
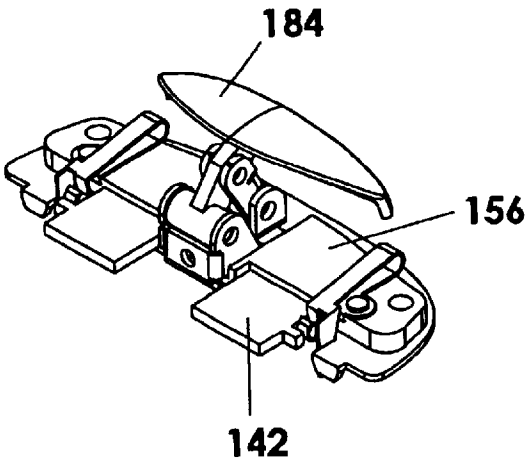

A snap lock generally designated by numeral 100 is shown in an exploded view in FIG. 1 and in an assembled perspective (without a cover) in FIG. 1'.

It is to be agreed, those terms such as "lower", "upper", "front", "back", "top", "bottom", "upwardly" and "downwardly" are conventionally used in the present specification with reference to the normal position in which snap lock 100 would be used with a vertically sliding window. The foregoing conventional approach does not preclude the use of snap lock 100 with windows or door using horizontal sliding.

Figure 2:
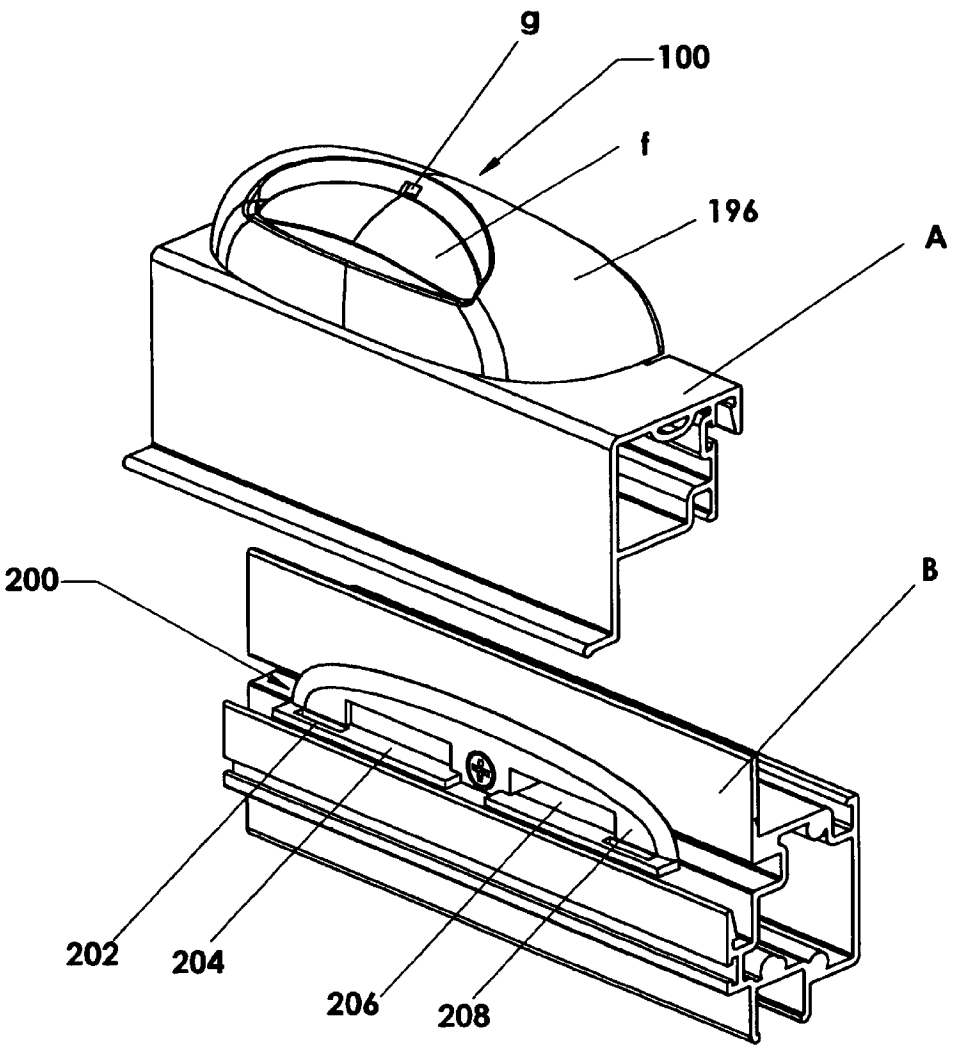
FIG. 2 is a fragment of a sash and a frame.

FIG. 2 illustrates a fragment of a sash A and a fragment of a frame B, both of a vertically sliding window. Snap lock 100 is attached to sash A, while a striking plate 200 is attached to frame B. As shown in the drawings, snap lock 100 comprises a stationary lower plate 110 that serves as a base, an intermediary rectilinearly mobile locking plate 142, superposed on top of stationary lower plate 110 and a stationary upper plate 156 that in turn is superposed on top of intermediary rectilinearly mobile locking plate 142. Stationary lower and upper plates 110 and 156, which capture between them intermediary rectilinearly mobile locking plate 142, are firmly attached together and adapted to be secured to sash A.

Furthermore, snap lock 100 includes a three-point pivoting mechanism 172 that provides an articulated connection between stationary lower plate 110 and intermediary rectilinearly mobile locking plate 142. A torsion wire spring 190 permanently biases outwardly intermediary rectilinearly mobile locking plate 142, while a pair of flat folded springs 192 serves to block or unblock intermediary rectilinearly mobile locking plate 142.

A cover 196 extends over an assembly formed of
stationary lower and upper plates 110 and 156;
intermediary rectilinearly mobile locking plate 142;
three-point pivoting mechanism 172; and
the pair of flat springs 192
and is adapted to be attached to stationary lower plate 110.

Figure 4:
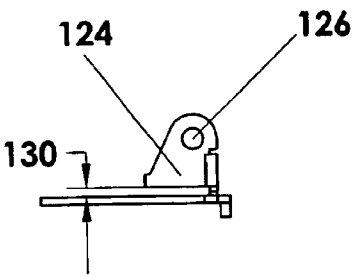
FIG. 4 is a right side elevation view of the stationary low plate.
Figure 3:
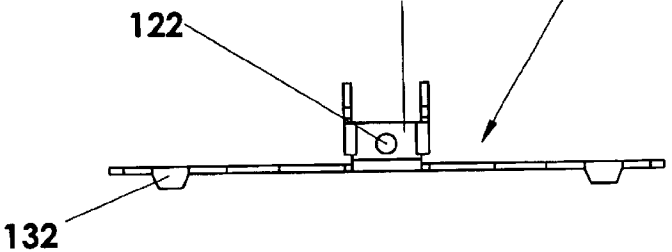
FIG. 3 is a front elevation view of a stationary low plate.
Figure 5:
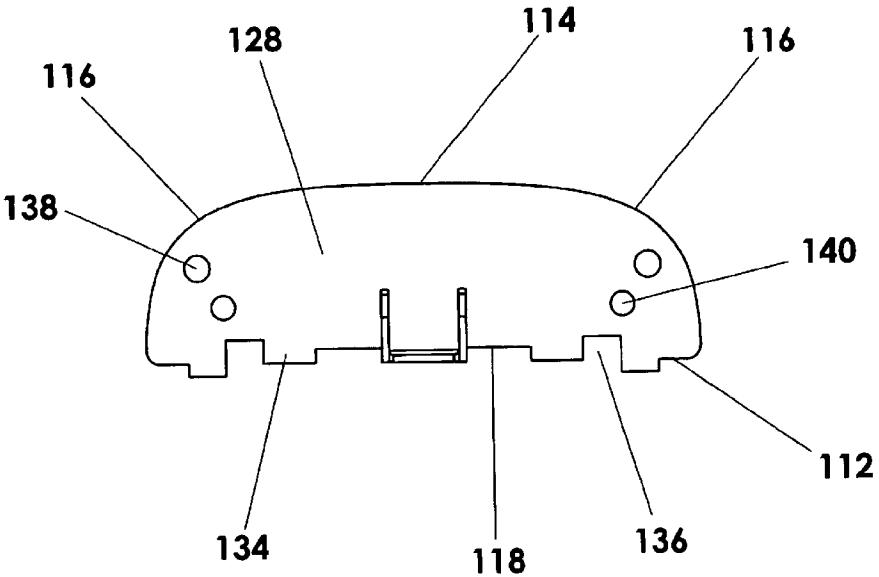
FIG. 5 is a top view of the stationary low plate.

Describing now in detail the components of snap lock 100, stationary lower plate 110 (see FIGS. 3 to 5) has an elongated shape, defined by a front and back edges 112 and 114, joined together by a pair of curved sides 116. Front edge 112 incorporates in its middle a linear retracted portion 118 from which centrally and upwardly extends a bent plate 120 that incorporates a threaded aperture 122. Bent plate 120 extends perpendicularly from its sides into a pair of brackets 124. Each bracket 124 is provided with a circular aperture 126. Circular apertures 126 are coaxial. The pair of brackets 124 terminates short of a top surface 128 of stationary lower plate 110, so that a gap 130 that separates the former from the latter is formed.

A pair of lugs 132 projects outwardly from the ends of front edge 112 and is perpendicular to top surface 128. The purpose of this pair of lugs 132 is to guide and center snap lock 100 with respect to striking plate 200, by penetrating into a pair of slots 202 situated in a horizontal part 204 of striking plate 200 (during a closing of a vertically sliding window). Furthermore, the pair of lugs 132 provides an added security to snap lock 100.

Between bent plate 120 and the pair of lugs 132, a pair of projections 134, coplanar with top surface 128, extends outwardly from linear retracted portion 118.

Between the pair of lugs 132 and the pair of projections 134, a pair of spring recesses 136 is formed. The purpose of the pair of spring recesses 136 will be disclosed further in the present description.

Stationary lower plate 110 further comprises, close to the pair of curved sides 116, a pair of attaching holes 138, and close to spring recesses 136, a pair of rivet holes 140. The purpose of the latter will be disclosed further in the present description.

Figure 7:
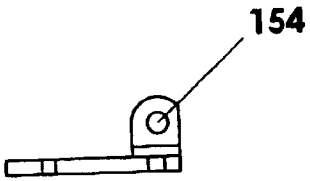
FIG. 7 is a right side elevation view of the intermediary rectilinearly mobile locking plate.
Figure 6:
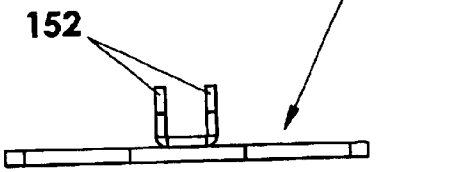
FIG. 6 is a front elevation view of an intermediary rectilinearly mobile locking plate.
Figure 8:
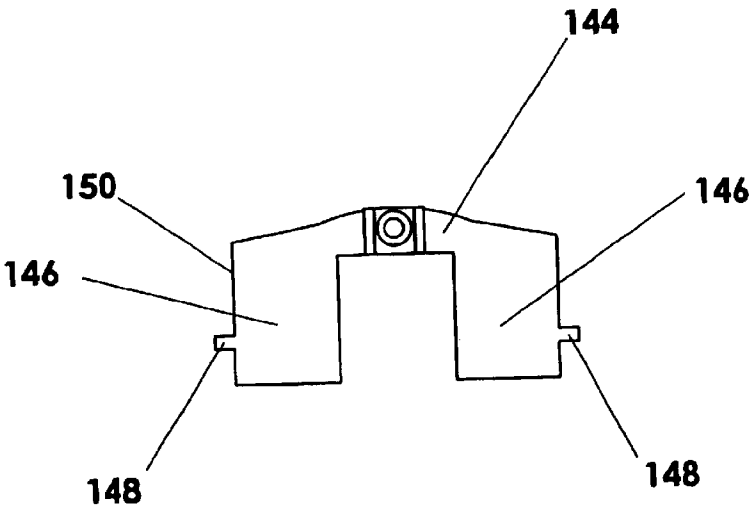
FIG. 8 is a top view of the intermediary rectilinearly mobile locking plate.

Intermediary rectilinearly mobile locking plate 142 (see FIGS. 6 to 8) is U-shaped and comprises a connecting web 144 from which extends a pair of locking legs 146. A stops tongue 148 projects outwardly from an external side 150 of each locking leg 146.

Intermediary rectilinearly mobile locking plate 142 further comprises a pair of right-angled supports 152 that extends outwardly from the middle of connecting web 144. Each right-angled support 152 contains a pivot opening 154.

Figure 9:
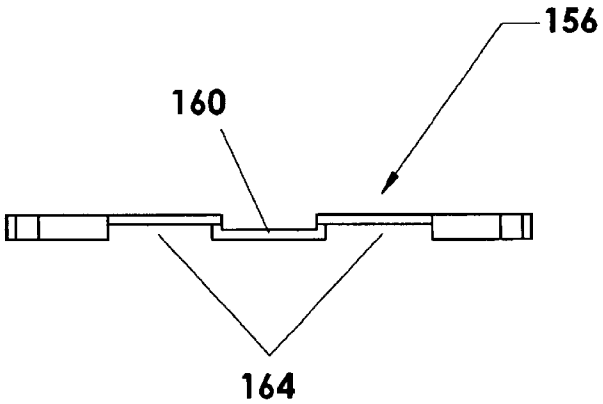
FIG. 9 is a front elevation view of a stationary upper plate.
Figure 10:
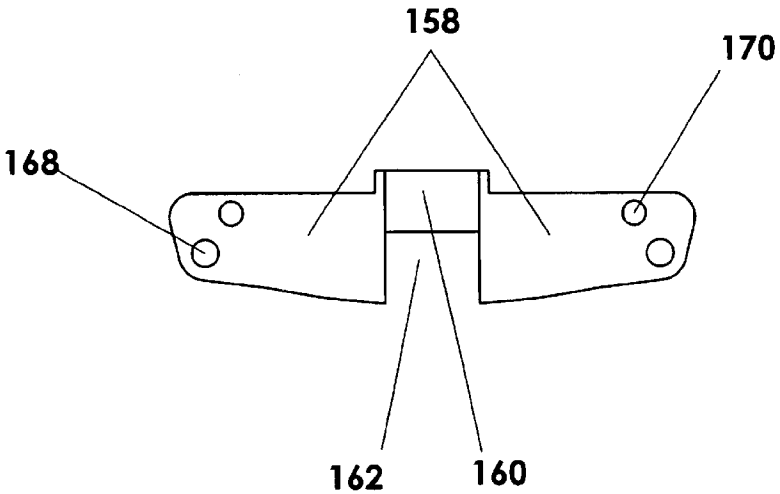
FIG. 10 is a top view of the stationary upper plate.

Stationary upper plate 156 (see FIGS. 9 and 10) has an elongated shape and comprises a pair of arms 158 connected, as viewed from the top, by a recessed central part 160. The latter has a depth that allows an easy running fit within gap 130. A cut-off 162 throughout stationary upper plate 156 is disposed behind recessed central part 160 and is so dimensioned as to allow movements in and out of the pair of right-angled supports 152 and, impliedly, of intermediary rectilinearly mobile locking plate 142. Thus, intermediary rectilinearly mobile locking plate 142 could translate with respect to stationary upper plate 156 that is attached to stationary lower plate 110 and together to sash A.

Stationary upper plate 156 further comprises a pair of niches 164 disposed at both sides of recessed central part 160. Each niche 164 has a width commensurable with a transversal dimension of a locking leg 146, without including stop tongue 148. Thus, during retracting, a travel of intermediary rectilinearly mobile locking plate 142 is terminated when stops tongues 148 abut a front margin 166 of stationary upper plate 156.

Stationary upper plate 156 is provided with corresponding attaching holes 168, identical and coaxial with attaching holes 138 of stationary lower plate 110, and with corresponding rivet holes 170 identical and coaxial with rivet holes 140 also of stationary lower plate 110.

Figures 11, 12, 13:
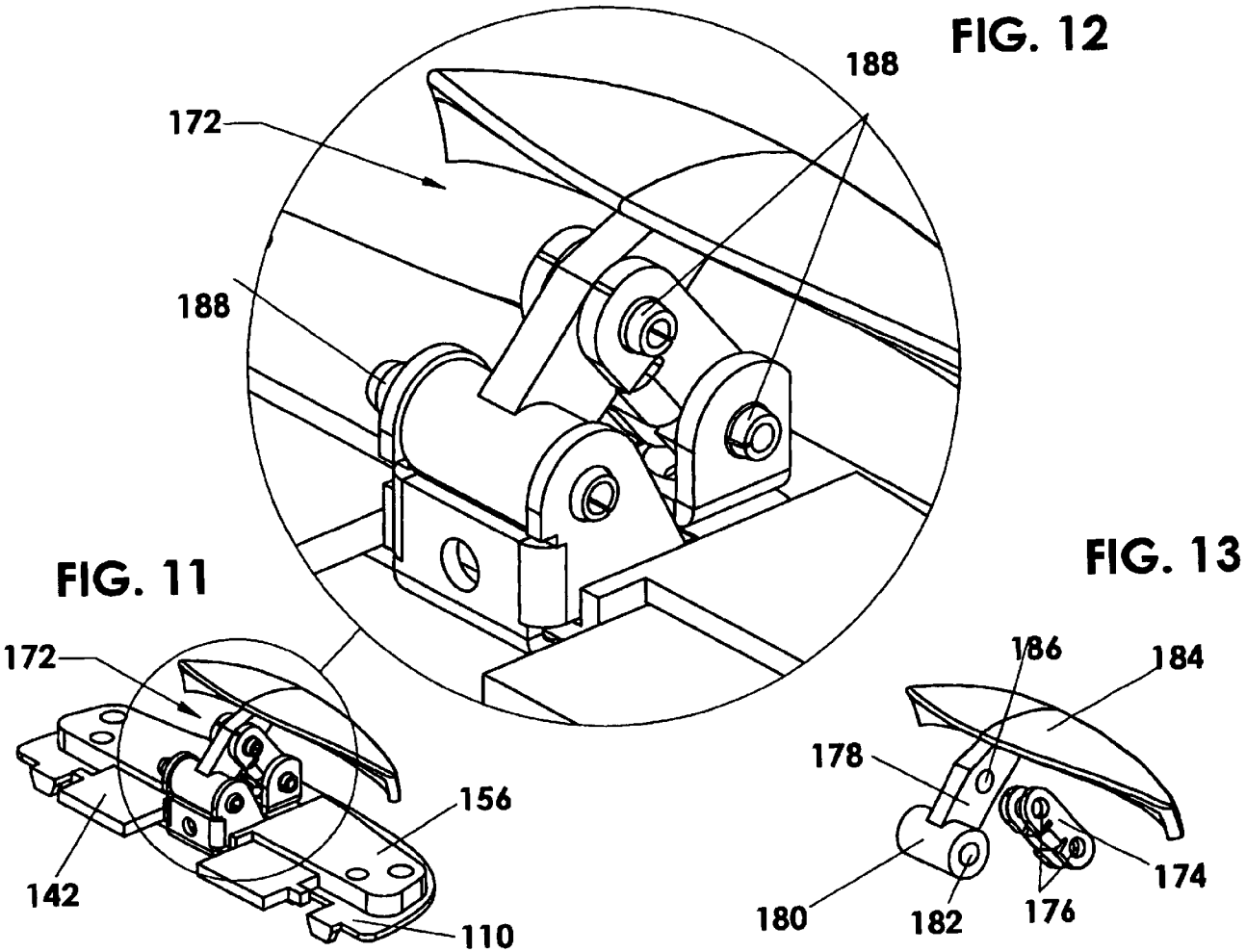
FIG. 11 is the assembled perspective view of the snap lock of FIG. 1' without flat springs.
FIG. 12 is an enlarged view of a three-point pivoting mechanism shown in FIG. 11.
FIG. 13 is an exploded perspective view of the three-point pivoting mechanism.
Figure 14:
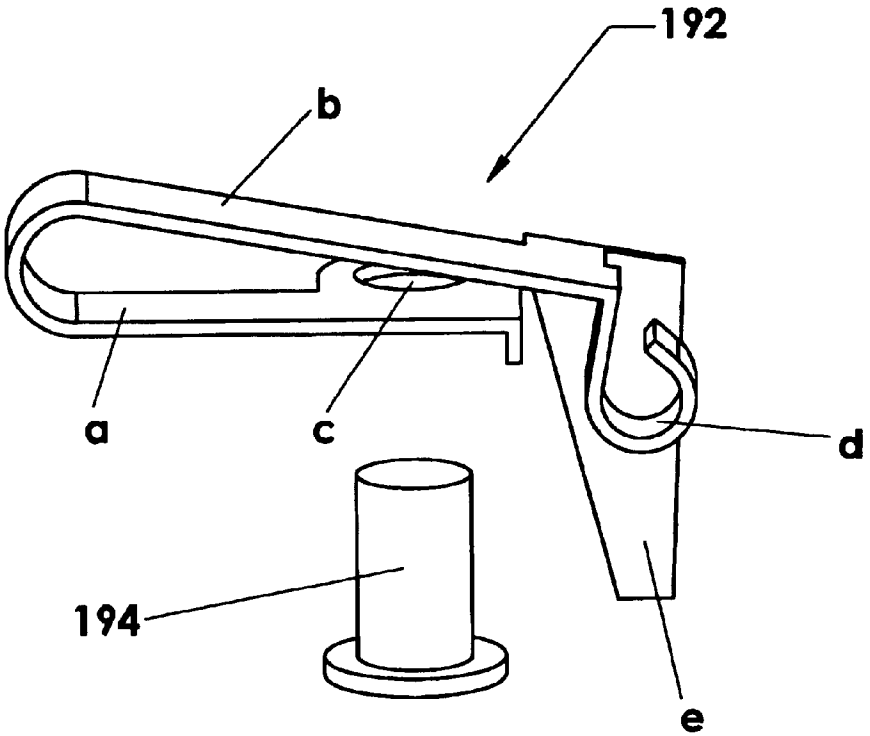
FIG. 14 a flat spring and a rivet used therewith.

Three-point pivoting mechanism 172 (see FIGS. 11 to 13) comprises

- a double flat-link 174 provided at each end with a pair of pin holes 176;
- a single flat-link 178 provided at on end with
  - an attaching roller 180 having an axial channel 182; and at another end with
  - a button 184; and, at approximately midway between one and another end, with
    - a midway opening 186, attaching roller 180 and button 184 being permanently secured to single flat-link 178;
- three link pins 188 of generally corresponding length, used as follows:
  - one link pin 188 inserted into circular apertures 126 of the pair of brackets 124 of stationary lower plate 110 and into axial channel 182 of attaching roller 180;
  - another link pin 188 inserted into midway opening 186 of single flat-link 178 and into the pair of pin holes 176 of double flat-link 174; and
  - another link pin 188 inserted into another pair of pin holes 176 of double flat-link 174 and into pivot openings 154 of the pair of right-angled supports 152; and
- a torsion wire spring 190, wound in spirals around link pin 188 that connects the pair of right-angled supports 152 with double-flat link 174, having one end for pressing on intermediary rectilinearly mobile locking plate 142 and another end for pressing on double flat-link 174, creates a tension load that resist torque.

Use is made of a pair of flat springs 192. Each flat spring 192 has basically a U-shape and is provided with a short lower and long upper arms "a" and "b", respectively. Short lower arm "a" extends laterally into an eyelet "c" used for inserting a rivet 194 that is forced into flat spring 192 and corresponding rivet holes 140 and 170, respectively. Rivets 194 serve as well to permanently join together snap lock 100 components even before mounting cover 196 and before attaching a completely assembled snap lock 100 to sash A. Even, in a case when the pair of flat springs 192 is replaced with a mechanically equivalent resilient component, a substantial role of rivets 194 is to permanently join together snap lock 100 components.

Long upper arm "b" continues downwardly and perpendicularly at one side with:

a double bent end "d" adaptable to be disposed in spring recess 136, and in front of stop tongue 148 when intermediary rectilinearly mobile locking plate 142 is backwardly fully retracted(unlocked position), and at another side with:

a cantilevered end "e" located beside double bent end "d" and intended to encounter, during a final stage of closing of a vertically sliding window, a horizontal part 204 of striking plate 200.

Thus, long upper arm "b" is moved away from short lower arm "a", so that double bent end "d" is lifted releasing stop tongue 148. Intermediary rectilinearly mobile locking plate 142 is now free for a forward rectilinear advancement. As a result, locking legs 146 penetrate into a pair of locking slots 206 provided in a vertical part 208 of striking plate 200.

To unlock snap lock 100, while sash A is in its lower position, button 184 is pushed down so that locking legs 146 retract from locking slots 206. During the initial pull up of sash A, while button 184 is still pushed down, cantilever ends "e" remain in contact with horizontal part 204 of striking plate 200, so that double bent ends "d" of long upper arms "b" are lifted. By continuing the pull up of sash A, cantilever ends "e" escape from a contact with horizontal part 204 of striking plate 200. At this moment, the pair of flat springs 192 is released from tension and, as a result, double bent ends "d" cease to be deflected. The latter return to their initial role of obstructing stop tongues 148 and so, keeping locking legs 146 retracted from a locking position. Pushing down of button 184 is no more necessary, since snap lock 100 is already unlocked and stays unlocked until sash A is lowered and cantilever ends "e" run into horizontal part 204. Conventional fasteners inserted into attaching and corresponding attaching holes 138 and 168 are used for securing snap lock 100 to sash A.

Cover 196 comprises an oval aperture "f" for locating button 184. A slit "g" for single flat-link 178 extends forwardly from generally oval aperture "f". Frontally, cover 196 is delimited by a ending vertical wall "h", centrally provided with a screw hole "i" coaxial with threaded aperture 122 of bent plate 120. When cover 196 is mounted, and a fastener (not shown) is inserted into screw hole "i" and in threaded aperture 122, a planar contact between bent plate 120 and ending vertical wall "h" is established. The latter has its lower part so configured as to leave space for the pair of lugs 132, for protruding parts of the pair of flat spring 192 and for the pair of locking legs 146.

As required, a detailed embodiment of the present invention is disclosed in the foregoing description; however, it is to be understood that the disclosed embodiment is merely exemplary of the invention, which may be embodied in various forms. Therefore, specific structural and functional details disclosed therein are not to be interpreted as limiting, but merely as a basis for the claims and as a representative basis for teaching one skilled in the art to variously employ the present invention in virtually any appropriately detailed structure.

What is claimed is:

1. Snap lock adaptable to be secured to a sash of a sliding window or door and to interact with a striking plate having horizontal and vertical plates and adaptable to be secured to a frame of said sliding window or door, said snap lock comprising, in combination, stationary lower and upper plate means for capturing between them rectilinearly mobile means for locking said snap lock with respect to said striking plate;

three-point pivoting means for interconnecting said foregoing means and, thereby, enabling to perform an unlocking operation;

springy means for keeping, when relieved from tension, said rectilinearly mobile means for locking said snap lock with respect to said striking plate in an unlocked, retracted position, and when under tension, for keeping said rectilinearly mobile means for locking said snap lock with respect to said striking plate in a locked, forwardly protruding position, said springy means for keeping being attached to said stationary lower and upper plate means for capturing and being actuated by a contact with said vertical plate; and a cover provided with an aperture for locating and accessing a button for acting upon said three-point pivoting means for interconnecting.

2. Snap lock, as defined in claim 1, wherein said springy means for keeping, when relieved from tension, said rectilinearly mobile means for locking said snap lock with respect to said striking plate in an unlocked, retracted position, and when under tension, for keeping said rectilinearly mobile means for locking said snap lock with respect to said striking plate in a locked, forwardly protruding position, includes a pair of flat springs, each of said pair of flat springs having basically a U-shape and being provided with a short lower and long upper arms, said short lower arm extending laterally into an eyelet adapted for inserting a rivet that is eventually forced into flat spring holes and corresponding flat spring holes disposed in said stationary lower and upper plate means for capturing, said long upper arm continuing downwardly and perpendicularly at one side with a double bent end and at another side with a cantilevered end located besides said double bent end.

* * * * *